United States Patent [19]

Goto et al.

[11] Patent Number: 5,022,375

[45] Date of Patent: Jun. 11, 1991

[54] SUPERCHARGING DEVICE OF AN ENGINE

[75] Inventors: Tsuyoshi Goto; Kouichi Hatamura; Shinji Seike, all of Hiroshima, Japan

[73] Assignee: Mazda Motor Corporation, Hiroshima, Japan

[21] Appl. No.: 331,382

[22] Filed: Mar. 31, 1989

[30] Foreign Application Priority Data

Mar. 31, 1988 [JP] Japan ..... 63-79892

[51] Int. Cl.[5] ..... F02B 33/00

[52] U.S. Cl. ..... 123/564

[58] Field of Search ..... 123/564

[56] References Cited

U.S. PATENT DOCUMENTS 4,350,135 9/1982 Casey et al. .
4,565,178 1/1986 Nagase ..... 123/564

FOREIGN PATENT DOCUMENTS 204211 12/1986 European Pat. Off. .
172426 10/1983 Japan ..... 123/564
59-77033 5/1984 Japan .
61-17138 1/1986 Japan .
61-78250 5/1986 Japan .
29021 2/1988 Japan ..... 123/564
1300170 3/1987 U.S.S.R. ..... 123/564

*Primary Examiner*—Douglas Hart
*Attorney, Agent, or Firm*—Wenderoth, Lind & Ponack

[57] ABSTRACT

In the present invention, in addition to a main throttle valve which is conventional, a sub-throttle valve for exclusive use of a mechanical supercharger is provided. By this sub-throttle valve, a flow rate of intake air is throttled by a fixed amount when the mechanical supercharger is switched from a non-connected state to a connected state. This makes it possible to prevent supercharged air from being bypassed to upstream of the supercharger through a bypass and also prevents generation of air intake noises. Moreover, in the case where the mechanical supercharger is of a type involving interior compression, at the time of the switching operation torque shock can be prevented and controllability of engine output by an accelerator pedal is improved.

23 Claims, 9 Drawing Sheets

SUPERCHARGING DEVICE OF AN ENGINE

BACKGROUND OF THE INVENTION

1. Field of the Invention

This invention relates to a supercharging device of an engine which is provided with a mechanical supercharger.

2. Description of a prior art

As a supercharging device of an engine, such a device as disclosed by Japanese Utility Model Registration Application Laying Open Gazette No. 61-78250, for example, has been known. According to this device, a mechanical supercharger which is driven by an engine is provided in an air intake passage downstream from a throttle valve, and a supercharging control valve is provided in the air intake passage between the mechanical supercharger and the throttle valve, whereby when a supercharging pressure reaches a set point, the supercharging pressure is maintained at that set point by adjusting the opening of the supercharging control valve so as to rationalize supercharging characteristics.

Another supercharging device as disclosed by Japanese Utility Model Registration Application Laying Open Gazette No. 61-17138 is such that a mechanical supercharger which is driven by an engine is provided in an air intake passage, a bypass which bypasses the mechanical supercharger is provided at the air intake passage, a throttle valve is provided in the air intake passage upstream of a joint of the bypass on an intake side of the supercharger, and a diaphragm type control valve which opens in response to an air intake negative pressure is provided in the bypass. According to this supercharging device, when the required output is small and negative pressure at the downstream of the throttle valve is large, the control valve opens, whereby supercharged air downstream from the supercharger is supplied upstream of the supercharger via the bypass so as to relieve negative pressure of intake air and prevent a temperature rise in the air intake passage. On the other hand, when the required output is large and a supercharging pressure downstream of the supercharger is also large, the control valve which has a function of a check valve opens by application of the supercharging pressure so as to relieve the supercharged air downstream from the supercharger to upstream of the supercharger via a bypass and prevent an excess of supercharging pressure.

In the above supercharging device provided with a mechanical supercharger, a bypass and a control valve in an air intake passage, it is suggested to provide a clutch between the mechanical supercharger and an output shaft of the engine so as to put the mechanical supercharger in a non-connected state, when the required output is small, by turning the clutch "OFF" and thereby supply intake air to the engine through the bypass, and when the required output is large, to put the mechanical supercharger in a connected state by turning the clutch "ON" and thereby supercharge the engine. With the above arrangement, when the required output is small, power to be absorbed by the mechanical supercharger becomes zero, with the result of a reduction in fuel usage, and when required output is large, it is possible to secure engine output.

However, in the above supercharging device with a clutch, when the clutch in the "OFF" state turns "ON" with the increase of required output and the mechanical supercharger is switched from a "non-connected state" to a "connected state", the mechanical supercharger is driven suddenly and the flow rate of the discharge air of supercharger increases. In this case, due to an overcharged pressure downstream from the supercharger, a control valve opens and supercharged air is relieved to upstream of the supercharger through the bypass. Therefore, a sound generated by the variation of pressure in the supercharger and other factors is transmitted to the upstream side of the supercharger as it is carried by the flow of the relieved air, with the result that a noise passes through the air intake passage and is emitted to the exterior.

SUMMARY OF THE INVENTION

A primary object of the present invention is to prevent generation of air intake noises by preventing supercharged air from being relieved to upstream of a supercharger via a bypass when the mechanical supercharger is switched from a "non-connected state" to a "connected state".

In order to attain the above object, in the present invention a sub-throttle valve for exclusive use of the supercharger is provided in addition to a main throttle valve, and by means of this sub-throttle valve, the flow rate of intake air is further throttled by a fixed quantity when the mechanical supercharger is switched from the "non-connected state" to "connected state".

In order to solve problems raised by conventional supercharging devices, the supercharging device according to the present invention is provided with an air intake passage for supplying intake air to an engine, a mechanical supercharger to be driven by an output shaft of the engine provided in the air intake passage, a switching means to switch the mechanical supercharger a "connected state" to a "non-connected state" in relation to the output shaft of the engine, a bypass in the air intake passage for bypassing the mechanical supercharger, a main throttle valve provided in the air intake passage upstream of a joint of the bypass on an intake side of the supercharger, and a sub-throttle valve provided in the air intake passage between the joint of the bypass on the intake side of the supercharger and the mechanical supercharger. With this arrangement, when the mechanical supercharger is switched from a "non-connected state" to a "connected state" by the above switching means, the sub throttle valve throttles the flow rate of intake air by the fixed quantity, in addition to throttling of the flow rate of intake air by the main throttle valve, and after the above switchover the sub-throttle valve opens according to the increase of required output of the engine or opens with a time lag.

According to the present invention with the above construction, when the required output is small, for example, the mechanical supercharger is put in a "non-connected state" by the operation of the switching means, whereby intake air is supplied to the engine through the bypass and power to be absorbed by the mechanical supercharger becomes zero, with resultant reduction in fuel consumption.

On the other hand, when the required output is large, the mechanical supercharger is put in a "connected state" by the operation of the switching means, whereby the engine is supercharged and output of the engine is secured.

With the increase of required output, when the mechanical supercharger is switched from a "non-connected state" to a "connected state" by the operation of the switching means, the mechanical supercharger is driven suddenly. In this case, however, the flow rate of intake air is further throttled by the fixed quantity by the sub-throttle valve, in addition to throttling of the flow rate of intake air by the main throttle valve, and after the above switchover the sub-throttle valve opens in accordance with the increase in required output of the engine or opens with a time lag, and accordingly the flow rate of discharge air of the supercharger increases gradually. This means that supercharged air is supplied to a combustion chamber without being relieved to a bypass and noise generated in the supercharger is transmitted to the combustion chamber as it is carried by the flow of the supercharged air. Thus, emission of intake air noise from the air intake passage to the exterior can be prevented.

BRIEF DESCRIPTION OF THE DRAWINGS

Preferred embodiments of the present invention are shown in the accompanying drawings, in which:

FIG. 1–FIG. 15 show a first embodiment of the present invention, wherein:

FIG. 1 is a schematic view of a supercharging device of an engine;

FIG. 2 is an explanatory graph of a working area of an electromagnetic clutch;

FIG. 3 is a graph showing the relation between r.p.m. of an engine and the opening of an accelerator;

FIG. 4 is a graph showing the relation between r.p.m. of an engine and r.p:m. of a supercharger;

FIG. 5 is a graph showing the relation between the opening of an accelerator and the opening of a main throttle valve;

FIG. 6 is a graph showing the relation between the opening of an accelerator and the opening of a sub-throttle valve;

FIG. 7 is a graph showing the relation between the opening of an accelerator and operation of an electromagnetic clutch;

FIG. 8 is a graph showing the relation between the opening of an accelerator and opening of a adjusting valve;

FIG. 9 is a graph showing the relation between the opening of accelerator and an intake air pressure;

FIG. 10 is a graph showing the time variation of the opening of a throttle valve;

FIG. 11 is a front view of a concrete construction of an engine;

FIG. 12 is a plan view thereof;

FIG. 13 is a side view of an upper part of an engine;

FIG. 14 is a side view of a mechanical supercharger; and

FIG. 15 is a front view thereof;

FIG. 16–FIG. 18 illustrate a second embodiment of the present invention, wherein:

FIG. 16 is a schematic view of a supercharging device of an engine;

FIG. 17 is a graph showing the relation between r.p.m. of an engine and volumetric efficiency;

FIG. 18 is a graph showing the relation between the opening of accelerator and the opening of a sub-throttle valve.

DESCRIPTION OF PREFERRED EMBODIMENTS

The above object and novel features of the present invention will be made more apparent from the following description with reference to the accompanying drawings.

A description is made below of each preferred embodiment of the present invention with reference to the accompanying drawings.

Figure 1:
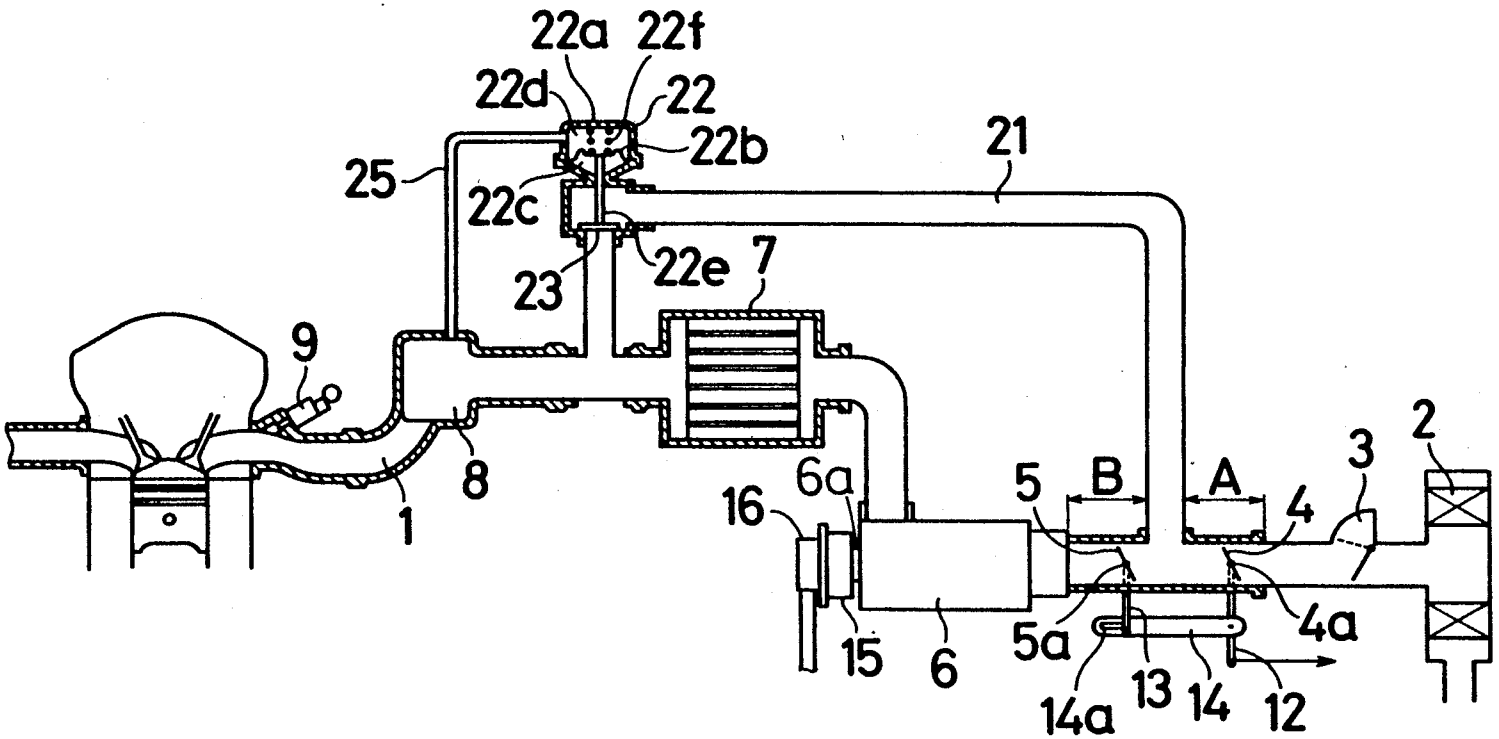

FIG. 1 schematically shows an outline of the composition of an engine provided with a supercharging device according to the first embodiment of the present invention.

In FIG. 1, reference numeral 1 designates an air intake passage for supplying intake air to an engine. One end of the air intake passage is open to the atmosphere via an air cleaner and the other end is connected to a combustion chamber of the engine.

Provided in the air intake passage is a supercharger 6 to be driven by the engine. The supercharger 6 is of the socalled screw type and involves interior compression. It pressurizes air drawn in from an intake at a fixed interior compression ratio and discharges it from an outlet. Reference numeral 21 designates a bypass provided in the air intake passage in such a fashion that it bypasses the supercharger 6. The bypass has a passage area which is large enough to secure a flow rate of intake air sufficient for producing required output of the engine when a switching means is in a non-connected state. A main throttle valve 4 is provided in the air intake passage upstream of a joint therewith of the bypass 21 on an intake side of the supercharger 6. The flow rate of the intake air is adjusted in accordance with the opening of the ma:n throttle valve 4. A sub-throttle valve 5 is provided in the air intake passage 1 between the joint of the bypass 21 with passage 1 on an intake side of the supercharger 6 and the mechanical supercharger 6, and the flow rate of intake air to be supplied to the mechanical supercharger 6 is throttled in accordance with the opening of the sub-throttle valve 5. In this case, a passage area of the air intake passage 1 upstream of the joint of the bypass on the intake side of the supercharger (area shown by A in FIG. 1) and that of the air intake passage 1 between the joint of the bypass on the intake side of he supercharger and the mechanical supercharger 6 (area shown by B in FIG. 1) are set to be almost the same. The opening of the sub-throttle valve 5 is set to the smaller than that of the main throttle valve 4 and is so designed that the flow rate of intake air is throttled further to a fixed quantity by the sub-throttle valve 5, in addition to throttling of the flow rate of intake air by the main throttle valve 4. Reference numeral 3 designates an airflow meter which is provided in the air intake passage 1 upstream of the main throttle valve 4 and that detects the flow rate of intake air. Reference numeral 7 designates an intercooler which is provided in the air intake passage downstream of the supercharger 6. Reference numeral 9 designates a fuel spraying valve which is provided in the air intake passage 1 and supplies fuel to the intake air by spraying.

A long first rod member 12 and a short second rod member 13 are connected to an axis of rotation 4*a* of the main throttle valve 4 and to an axis of rotation 5*a* of the sub-throttle valve 5, respectively. While a middle portion of the first rod member 12 is connected to one end of a link member 14, an outer end of the second rod member 13 is mounted in an opening 14*a* formed in the other end of the link member 14. An accelerator pedal (not shown in the drawing) is connected to a top end of the first rod member 12, and the design is such that opening of the main throttle valve 4 and of the sub-throttle valve 5 are varied by operating such pedal. More particularly, with an increase of opening of the accelerator, namely, with an increase of required output of the engine, both throttle valves open and increase the flow rate of discharge air of the mechanical supercharger. The design is such that in the case where noise caused by pressure pulsation which is generated due to a difference in pressure between the discharge pressure of the mechanical supercharger 6 and the pressure in the air intake passage downstream of the supercharger is emitted, the opening of the sub-throttle valve 5 is controlled to prevent such noise.

An axis of rotation 6*a* of the supercharger 6 is connected to a conventional variable pulley mechanism 16 via an electromagnetic clutch 15 as a switching means. The variable pulley mechanism 16 has a function of making its pitch diameter variable and is driven by the engine.

Figure 2:
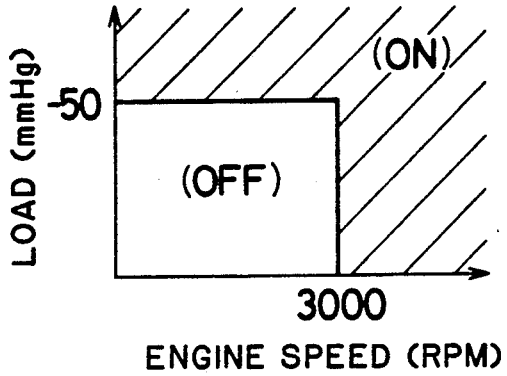
Figure 3:
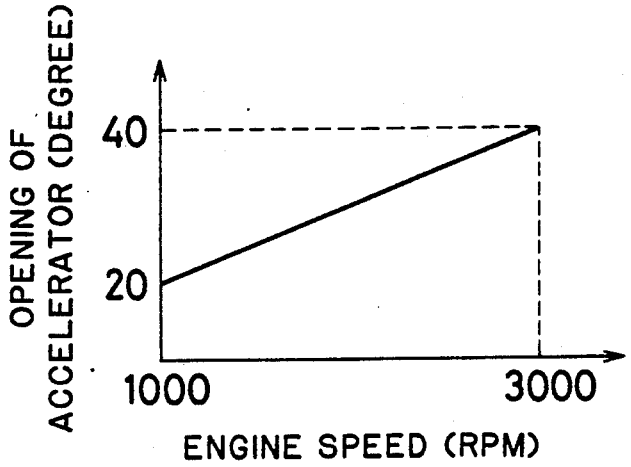

The electromagnetic clutch 15 switches the mechanical supercharger from a "connected state" over to a "non-connected state", or vice versa. More particularly, by turning the electromagnetic clutch 15 "ON", the mechanical supercharger 6 is put in the "connected state" where engine driving power is transmittable to the mechanical supercharger 6, whereby the engine is supercharged and the engine output is secured. On the other hand, by turning the electromagnetic clutch 15 "OFF", the mechanical supercharger 6 is put the "non-connected state" where the engine driving power is not transmitted to the supercharger 6, whereby the intake air is supplied to the engine through the bypass 21 and power to be absorbed by the supercharger 6 becomes zero, with resultant reduction of fuel expenses. As shown in FIG. 2, in consideration of the durability of the clutch, the electromagnetic clutch 15 is kept "ON", except within a low-load, low-rotation area. FIG. 3 shows the relation between r.p.m. of the engine and the opening of the accelerator when the mechanical supercharger 6 is switched to the "connected state" and to the "non-connected state".

Figure 4:
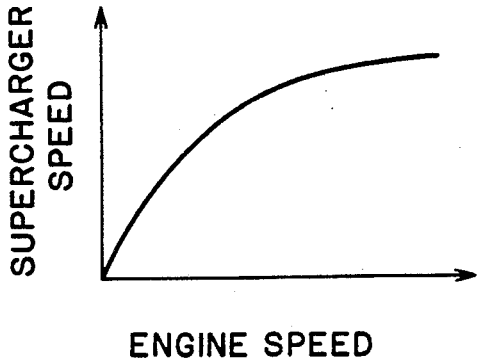

Due to the variable pulley mechanism 16, the mechanical supercharger 6 is so designed that the number of revolutions thereof increases with the increase in r.p.m. of the engine, as shown in FIG. 4.

A adjusting valve 23 which is controlled for operation by a diaphragm device 22 is provided in the bypass 21. The diaphragm device 22 is provided with a casing 22*a*, diaphragm 22*b* arranged in the casing 22*a*, a first chamber 22*c* and a second chamber 22*d* which are divided from each other by the diaphragm 22*b*, a spring 22*f* compressed in the second chamber 22*d* and a rod 22*e* having one end connected to the diaphragm 22*b*. The, other end of the rod 22*e* is connected to valve 23. Chamber 22*d* communicates with a surge tank 8 through a negative pressure passage 25. With the above arrangement, if negative pressure in the surge tank 8 is higher than a set point, the diaphragm 22*b* deviates against the spring force of the spring 22*f* and causes the adjusting valve 23 to open.

Operation of the main throttle valve 4, the sub-throttle valve 5 and the electromagnetic clutch 15 are explained below.

Figure 5:
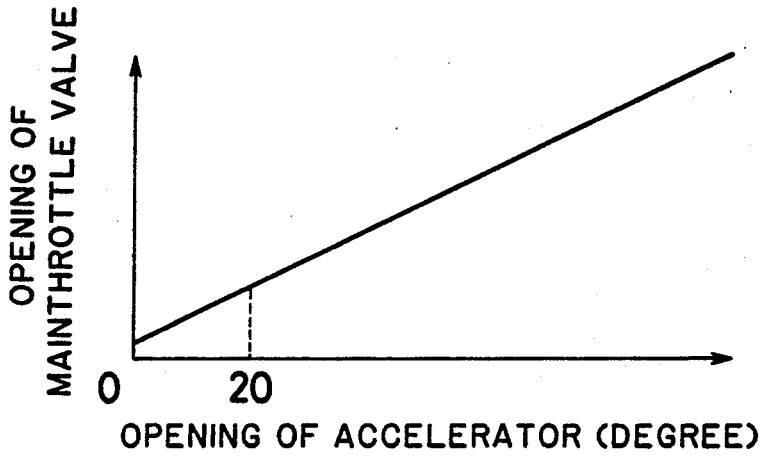
Figure 6:
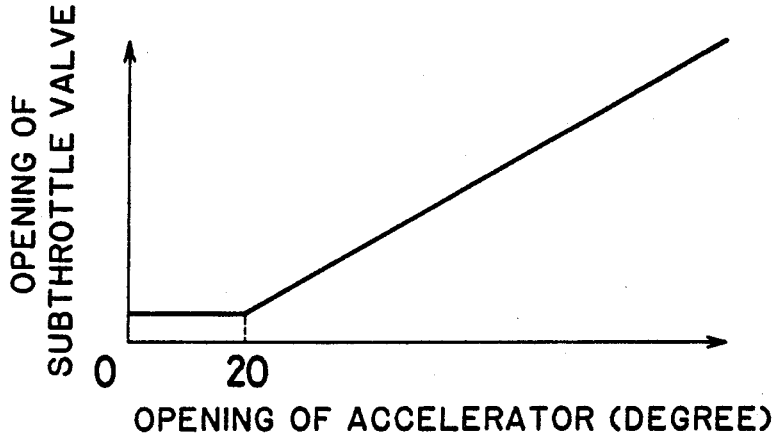
Figure 7:
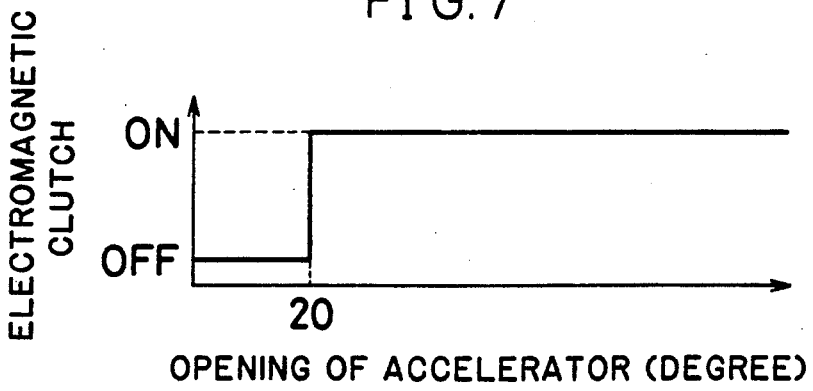
Figure 8:
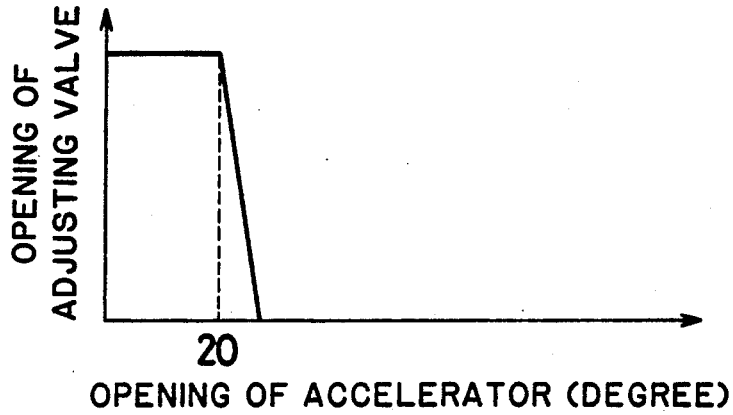

FIG. 5–FIG. 10 show variations of the amount of each state with an increase of the opening of the accelerator in the case where the mechanical supercharger 6 is switched from the "non-connected state" to the "connected state" when the engine speed is about 1,000 r.p.m. As shown in FIG. 5, the opening of the main throttle valve 4 increases substantially in proportion to the increase of the opening of the accelerator. As shown in FIG. 6, when the opening of the accelerator exceeds 20 degrees, the sub-throttle valve 5 which has been totally closed begins to open and thereafter the openings thereof increases substantially in proportion to the increase of the opening of the accelerator. As shown in FIG. 7, when the opening of the accelerator exceeds 20 degrees, the electromagnetic clutch 15 which has been in an "OFF" state is switched to "ON" and the supercharger 6 is switched from the "non-connected state" to the "connected state", and the flow rate of intake air is further throttled by the fixed quantity by the sub-throttle valve 5, in addition to throttling of flow rate of the intake air by the main throttle valve 4. After the above switchover, the sub-throttle valve 5 opens in accordance with the increases of the required output of the engine and the flow rate of discharge air from the mechanical supercharger 6 increases gradually. As shown in FIG. 8, when the opening of the supercharger exceeds 20 degrees, the adjusting valve 23 which has been totally opened is closed with the lapse of a fixed period of time.

Intake air pressure at each part of the air intake passage 1 is explained below with reference to FIG. 9.

Figure 9:
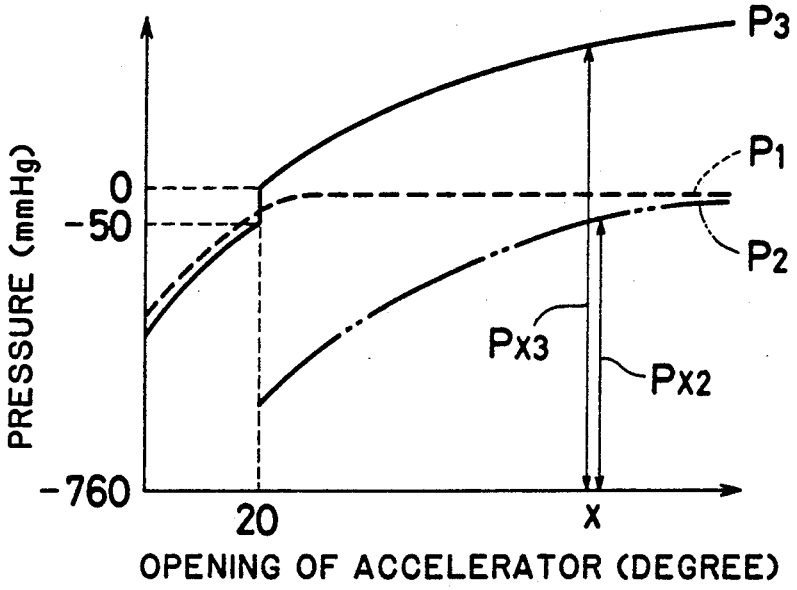
Figure 10:
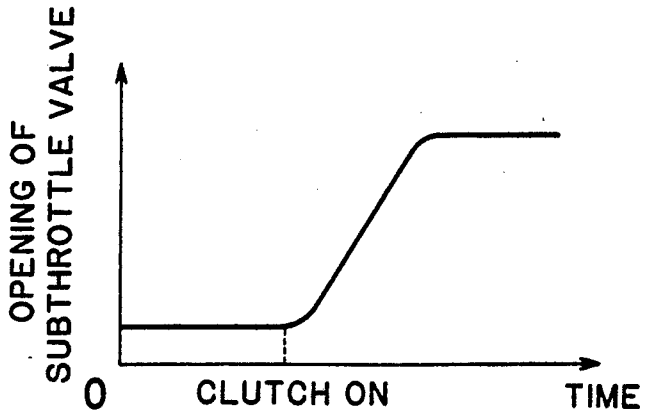
Figure 11:
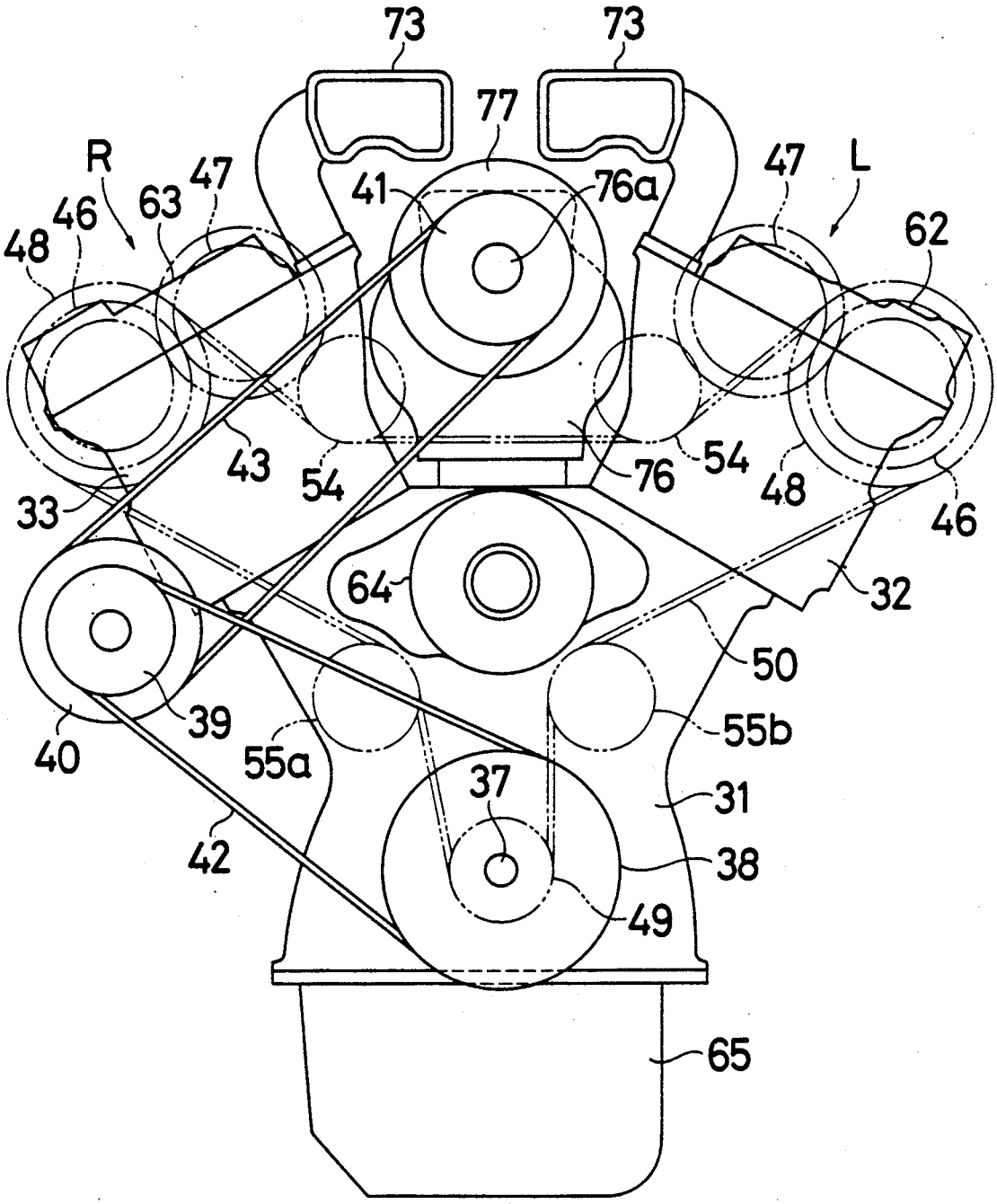
Figure 12:
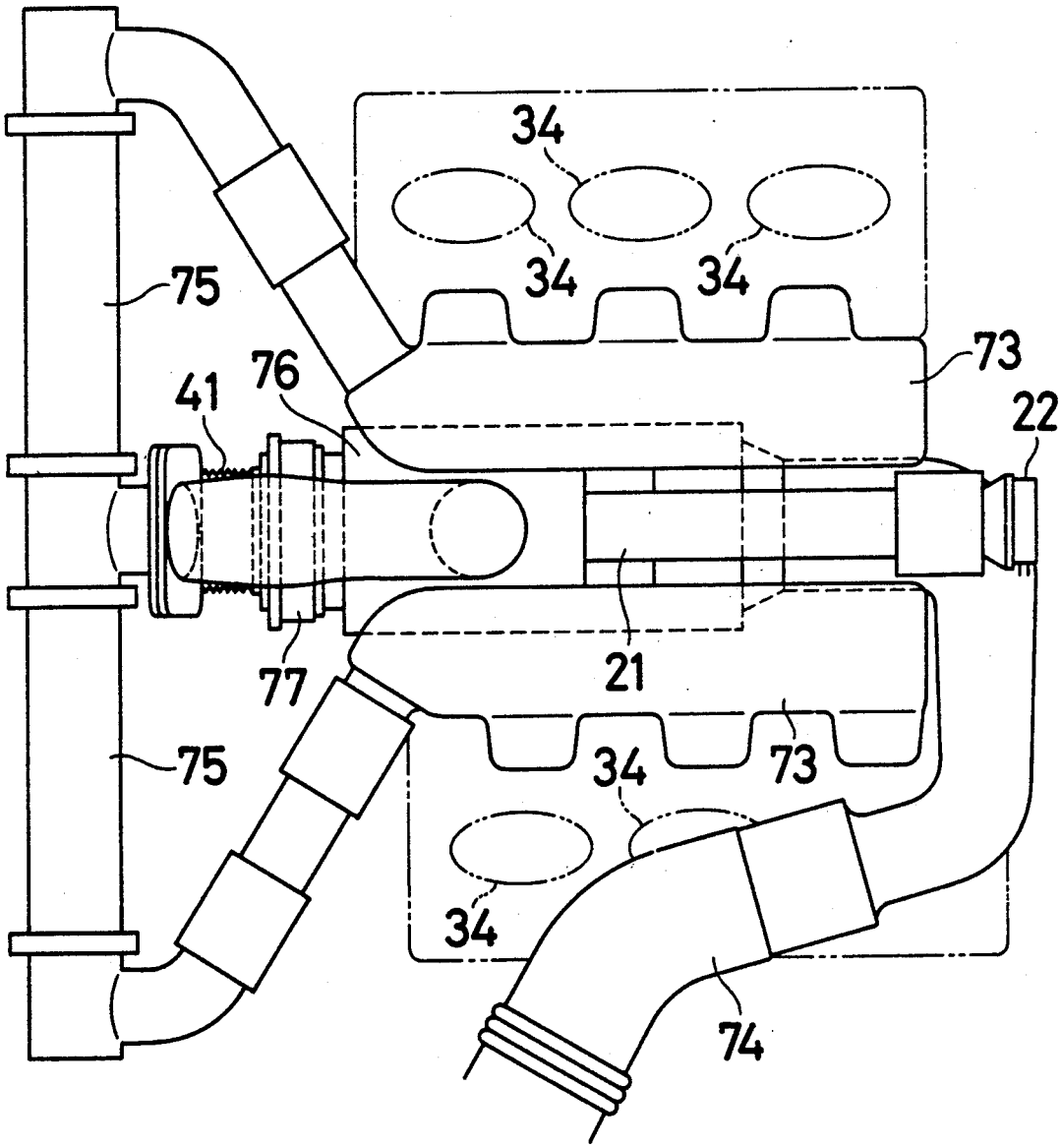
Figure 13:
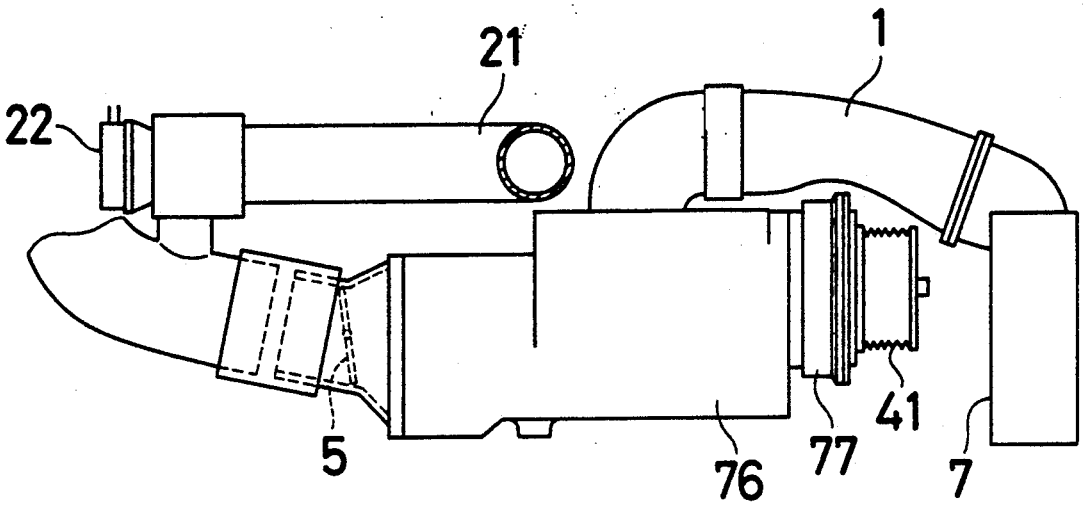
Figure 14:
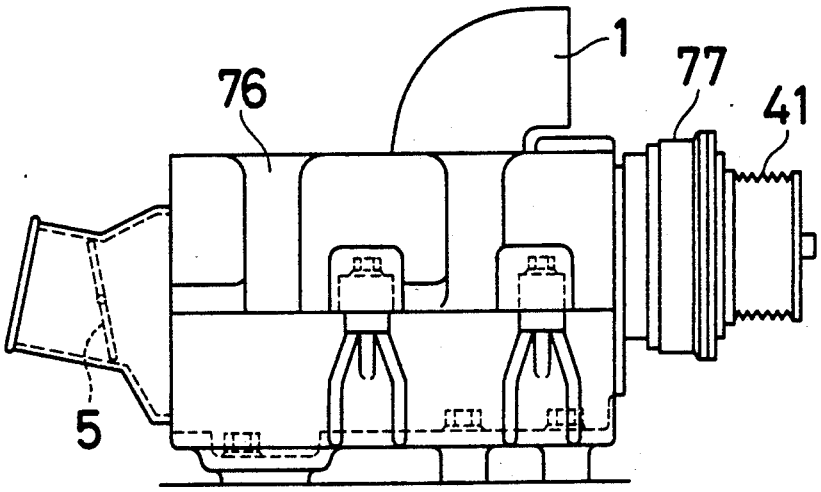
Figure 15:
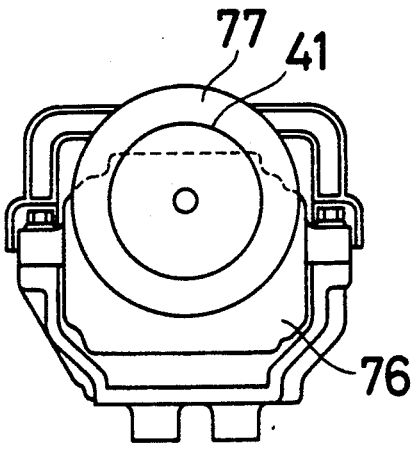

Intake air pressure $P_1$ immediately downstream of the main throttle valve 4 rises from a negative valve substantially to atmospheric pressure, with the increase of the opening of accelerator, as shown by a broken line in FIG. 9, and when and after the opening of the accelerator exceeds the level of 20 degrees, $P_1$ is maintained at the level of atmospheric pressure. Intake air pressure $P_2$ immediately downstream the sub throttle valve 5 conforms substantially to the intake air pressure $P_1$ until the opening of the accelerator exceeds the level of 20 degrees and intake air begins to be drawn in by the supercharger 6, the intake air is throttled by the sub-throttle valve 5 and its pressure drops abruptly but thereafter rises to the level of atmospheric pressure due to the increase of the opening of the sub-throttle valve 5 with the increase of the opening of the accelerator, as shown by a chain line in FIG. 9. On the other hand, intake air pressure $P_3$ in the surge tank 8 conforms to the intake air pressure $P_1$ until the opening of the accelerator exceeds substantially 20 degrees, but when and after the opening of the accelerator exceeds 20 degrees and the mechanical supercharger 6 is put in the "connected state", $P_3$ rises by the fixed amount and thereafter continues to rise with the increase of the opening of the accelerator, as shown in by a solid line in FIG. 9. The intake air pressure $P_3$ rises by the fixed amount when the opening of the accelerator exceeds substantially 20 degrees and an increase in torque to be obtained by this rise of pressure is absorbed as a driving torque of the mechanical supercharger 6. Therefore, torque to be obtained finally is connected smoothly even near the point where the mechanical supercharger 6 is switched from the "non-connected state" to the "connected state".

The relation between the intake air pressure $P_2$ immediately downstream of the sub-throttle valve 5 and the intake air pressure $P_3$ in the surge tank will be examined below.

As shown in FIG. 9, where $P_{\times 2}$ is an air intake pressure $P_2$ at an arbitrary opening of accelerator x, $P_{\times 3}$ is an air intake pressure $P_3$ at the arbitrary opening of accelerator x, $V_E$ is a suction force of the engine (volume of intake air drawn in by the engine per unit time) and $V_S$ is a suction in force of the mechanical supercharger 6 (volume of intake air drawn in by the supercharger 6 per unit time), the following relationship is established:

$$(V_E)\times(P_{\times 2})/V_S=P_{\times 2}$$

However, the influence of an inertia surcharging effect of the intake system and the influence exerted by variations of r.p.m. of the mechanical supercharger 6 by the variable pulley are disregarded in the above case. Therefore, from the above formula, ratio $\tau$ between $P_{\times 2}$ and $P_{\times 3}$ is $$\tau=P_{\times 3}/P_{\times 2}=V_S/V_E$$

Thus, $\tau$ takes a fixed value on the basis of $V_S$ and $V_E$ which are peculiar to the engine with a supercharger, namely, the ratio between the intake air pressure $P_2$ and the intake air pressure $P_3$ always takes a fixed value. Therefore, if the interior compression ratio of the mechanical supercharger 6, namely the ratio of discharge pressure to the intake pressure, is set to such fixed value, the correspond to, discharge pressure of the mechanical supercharger 6 substantially conforms to the intake pressure downstream of the mechanical supercharger, and generation of pressure pulsation near the outlet of the mechanical supercharger 6 is restricted. In addition, supercharged air discharged from the mechanical supercharger 6 is supplied to a combustion chamber without being relieved to the bypass 21, and generation of noise from the mechanical supercharger is transmitted to the combustion chamber as it is carried by the flow of supercharged air. Therefore, there is no fear that intake noise is emitted to the outside from the air intake passage 1.

Since the discharge pressure of the mechanical supercharger 6 substantially corresponds to the intake air pressure downstream of the supercharger and torque to be obtained finally is connected smoothly even near the point where the mechanical supercharger 6 is switched over, there is no generation of torque shock at such switchover.

In addition, since the sub-throttle valve 5 is provided in addition to the main throttle valve and the flow rate of intake air toward the mechanical supercharger 6 is controlled carefully by the sub-throttle valve 5 in an operating area where the mechanical supercharger 6 is driven, controllability of engine output by the accelerator pedal is improved.

An explanation is made below of the intake air pressure and the flow rate of intake air, using concrete numerical values.

(1) In the case of 700–3,000 r.p.m.

At the time of low load, the electromagnetic clutch 15 is "OFF", the mechanical supercharger 6 is not driven, the opening of the main throttle valve 4 is slight, the sub-throttle valve 5 is closed, and the bypass 21 is in an intercommunicative state. Therefore, intake air flows through the bypass 21 and a natural air intake state is obtained. Suppose the maximum supercharged pressure and the flow rate of air at that time are 2 atm and V respectively, the pressure downstream of the main throttle valve 4 is about 0.4 atm and the amount of air intake is 1/5 of the maximum air intake amount V.

If the opening of the accelerator increases, the main throttle valve 4 opens to some extent but the sub-throttle valve 5 still remains "closed", the electromagnetic clutch 15 is still "OFF" and the mechanical supercharger 6 is not yet driven. Therefore, the pressure downstream of the main throttle valve 4 is about 0.6 atm and the amount of air intake becomes 3/10 V.

If the opening of the accelerator increases further and the main throttle valve 4 opens up to 20 degrees, the flow rate of intake air becomes ½ V and the pressure reaches as high as 1 atm. At this time, the sub-throttle valve 5 begins to open slightly.

In the above state, the electromagnetic clutch 15 turns "ON" and the bypass 21 is closed by the adjusting valve 23. In this case, intake air begins to flow through the mechanical supercharger 6 but is throttled by the sub-throttle valve 5 and the flow rate of the air intake is ½ V.

When the electromagnetic clutch 15 is "ON", the bypass 21 is closed by the adjusting valve 23 and the mechanical supercharger 6 is driven, the pressure downstream of the sub-throttle valve 5 is 0.6 atm, the pressure upstream of the surge tank 8 is 1.2 atm and the amount of air intake is 3/5 V.

If the opening of the accelerator increases still more and a high load is reached, both the main throttle valve 4 and the sub-throttle valve 5 open to the full extent, the pressure upstream of the mechanical supercharger 6 becomes 1.0 atm, the intake air pressure in the surge tank becomes 2 atm and the amount of air intake becomes V.

(2) In the case of more than 3,000 r.p.m.

At the time of high speed running (engine speed of more than 3,000 r.p.m.), there occurs the problem of durability of the electromagnetic clutch to switch the electromagnetic clutch 15 from "OFF" to "ON". Therefore, the electromagnetic clutch 15 remains "ON".

At the time of low load, both the main throttle valve 4 and the sub-throttle valve 5 are closed, the pressure downstream of the main throttle valve 4 is 0.4 atm, the pressure downstream of the sub-throttle valve 5 is 0.2 atm, the intake air pressure upstream of the surge tank 8 is 0.4 atm and the amount of air intake is 1/5 V.

If the opening of the accelerator increases and medium load is reached, the main throttle valve 4 half opens, the sub-throttle valve 5 opens to some extent, the pressure downstream of the main throttle valve 4 reaches about 1 atm, the pressure downstream of the sub-throttle valve 5 reaches 0.6 atm, the pressure of intake air to be drawn into the combustion chamber is 1.2 atm and the amount of air intake becomes 3/5 V.

If the opening of the accelerator increases further and high load is reached, both the main throttle valve 4 and the sub-throttle valve 5 open to the full extent, the pressure upstream of the mechanical supercharger 6 reaches 1.0 atm, the pressure of intake air in the surge tank is 2 atm and the amount of air intake becomes V.

Both at the time of medium load and at the time of high load, the bypass 21 is kept closed by the adjusting valve 23.

A concrete construction of the engine is explained below with reference to FIGS. 11–15.

The engine is of the V type. Cylinder heads 32, 33 are provided on a cylinder block 31. A left bank L and a right bank R are formed by the cylinder block 31 and the cylinder heads 32, 33. A mechanical supercharger 76 is arranged between the left bank L and the right bank R through the medium of a fitting member (not shown in the drawing) of the cylinder block 31. A driving shaft 76*a* of the mechanical supercharger 76 is driven for rotation by a crank shaft 37 through the medium of a pulley 38 fitted to a forward end of the crank shaft 37, two coaxial intermediate pulleys 39, 40 arranged coaxially at the right outward side of the cylinder block 31, a pulley 41 fitted to a forward end of the driving shaft 76*a* and two belts 42, 43 running over the pulleys 38, 39 and the pulley 40, 41, respectively.

Each of the pulleys 38, 39 has a conventional variable pulley mechanism which is variable in pitch diameter. With the increase of r.p.m. of the engine, while the pitch diameter of the pulley 39 becomes small, that of the pulley 38 becomes large. As a result, with the increase of r.p.m. of the engine, r.p.m. of the mechanical supercharger 76 decreases and the flow rate of intake air is regulated properly. Thus, wasteful operation of the mechanical supercharger 76 is eliminated.

Each of the cylinder heads 32, 33 is provided with a cam shaft for air intake and a cam shaft for air discharge. By these cam shafts, an air intake valve and an air discharge valve are driven to carry out air suction and air discharge at a fixed timing.

While provided at a forward end of the cam shaft for air discharging at the outer side of each of the bank L and the bank R is a timing pulley 48, provided at a forward end of the crank shaft 37 is a timing pulley 49 having a pitch diameter which is one half of that of the pulleys 48, and a belt 50 is wound round the pulleys 48 and the pulley 49. Through the medium of the timing belt 50, the cam shafts for the air discharge valves are driven to rotate synchronously in such a fashion that up and down strokes of the right and left air discharge valves are contrary to each other. A mechanism for transmitting the rotation of the crank shaft 37 to each cam shaft for the air discharge valve is composed the the timing pulleys 48, 49 and the timing belt 50.

Two idle pulleys 54 which guide the timing belt 50 are provided below and on both sides of the mechanical supercharger 76 in such a fashion that they make contact with the outer surface of the timing belt 50. By these idle pulleys 54, the timing belt 50 is forced to slope downward so that the mechanical supercharger 76 and the timing belt 50 do not interfere with each other. Also, two other idle pulleys 55*a*, 55*b* are provided above the crank shaft 37 in such a fashion that they make contact with the outer surface of the timing belt 50 and guide the timing belt 50. Of these two idle pulleys 55*a*, 55*b*, the idle pulley 55*a* is so designed that it functions as a tension pulley.

Provided in each of the left bank L and the right bank R is a gear 46 which is coaxial with the respective timing pulley 48. By engaging the gear 46 with a gear 47, having the same pitch diameter and the same module as the gear 46, which is fitted to the cam shaft for air intake, rotation of the cam shaft for air discharge is transmitted to the cam shaft for air intake.

Reference numerals 62, 63 designate cylinder head covers arranged on the cylinder heads 32, 33, respectively. Reference numeral 64 designates a casing for a water pump which is arranged by utilizing space surrounded by the timing belt 50. Reference numeral 65 designates an oil pan disposed at the underside of the cylinder block 31.

Reference numeral 73 designates surge tanks which are provided above each of the left bank L and the right bank R and which communicate with each other so that intake air can circulate between cylinders 34 on opposite sides of the block. Reference numeral 74 designates an air intake passage which extends frontward from above the mechanical supercharger 76 and then branches into both sides to be connected to each surge tank 73. Reference numeral 75 designates intercoolers which are arranged with the air intake passage 74 interposed therebetween and cool down intake air to be discharged from the mechanical supercharger 76. Reference numeral 77 designates an electromagnetic clutch.

In the above embodiment, since the mechanical supercharger 76 is arranged above and between the left and right banks L, R, space above the middle of a V type engine can be utilized effectively as space for installation of auxiliary machines.

Figure 16:
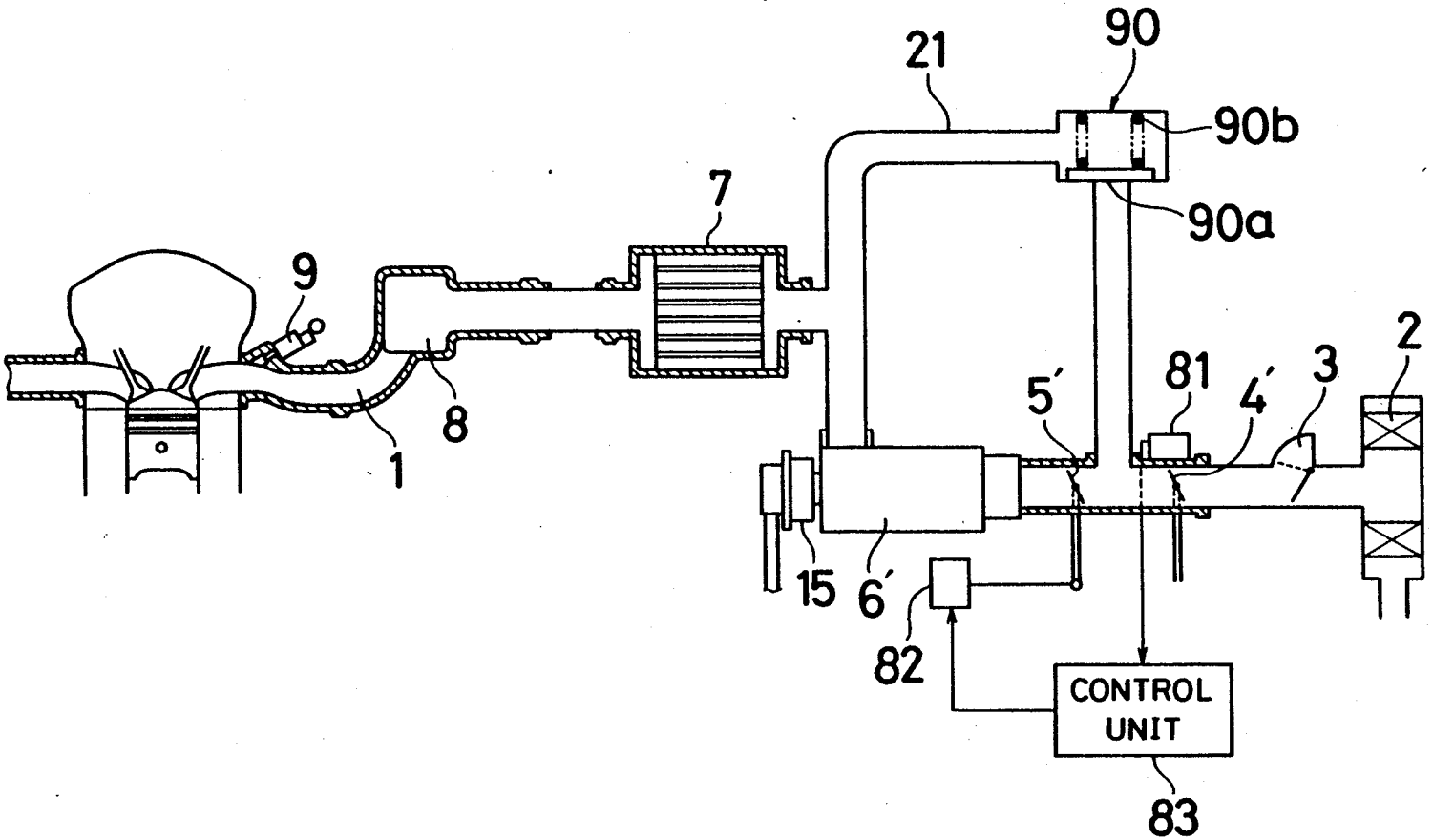

FIG. 16 shows the second embodiment of the present invention. In the first embodiment, the main throttle valve 4 and the sub-throttle valve 5 are connected mechanically to the accelerator pedal through the medium of the rod members 12, 13 and the link member 14, but in the second embodiment, only the main throttle valve 4' is connected mechanically to the accelerator pedal, and the sub-throttle valve 5' is connected with an actuator 82 by which the sub-throttle valve 5' is driven. The actuator 82 is controlled by a control unit 83. The main throttle valve 4' is connected with a sensor 81 for detecting the opening of the main throttle valve, and an output signal of the opening sensor 81 is input to the control unit 83.

In the first embodiment, the adjusting valve 23 is controlled for operation by the diaphragm device 22 in the bypass 21, but in the second embodiment, a check valve 90 is provided in the bypass 21. The check valve 90 is equipped with a valve body 90*a* which opens by pressure from upstream of the air intake passage and closes by pressure from downstream of the intake air passage and a spring 90*b* which forces the valve body 90*a* toward a closing position. The check valve 90 keeps intake air from flowing to the bypass 21 when the mechanical supercharger 6' is in the "connected state". In the second embodiment, the bypass 21 communicate with the upstream end of the intercooler 7. In other basic respects, the second embodiment is similar to the first embodiment.

Figure 17:
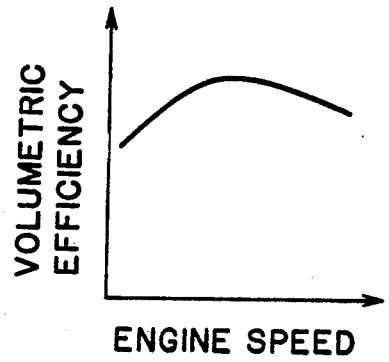
Figure 18:
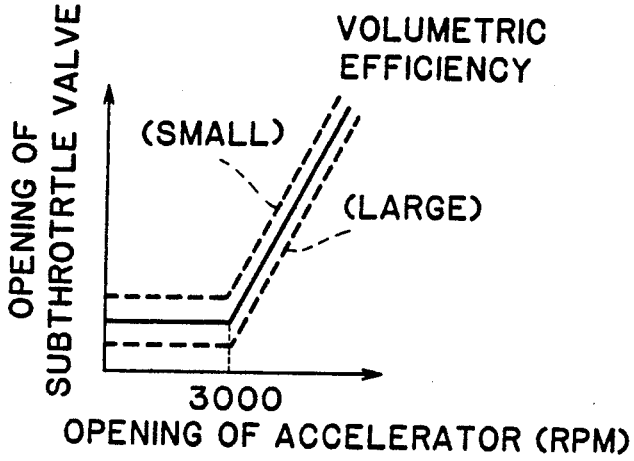
Figure 19:
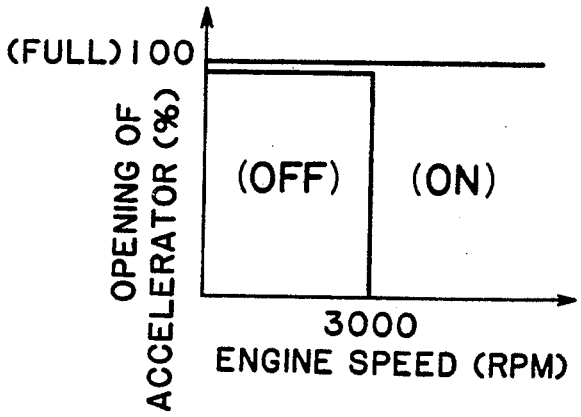
FIG. 19 is an explanatory graph of the working area of an electromagnetic clutch in a modified example.

An explanation is made below of the operation of the actuator by the control unit 83. Basically, as shown by a solid line in FIG. 18, with an increase of the opening of the accelerator, namely, with an increase of the required output of the engine, the sub-throttle valve 5' opens and the flow rate of discharge air from the mechanical supercharger 6 increases. By this basic control, as in the case of the first embodiment, such effects as prevention of generation of air intake noises, prevention of generation of torque shock and improvement of controllability of engine output by the accelerator pedal are obtained. In addition to this basic control, in the second embodiment due consideration is given of the influence of the inertia supercharging effect of the air intake system and the influence exerted by variations of r.p.m. of the mechanical supercharger by variable pulleys. As shown in FIG. 17, the volumetric efficiency varies with r.p.m. of the engine due to the influence of the inertia supercharging effect of the air intake system and the influence exerted by variations of r.p.m. of the mechanical supercharger 6 by variable pulleys. In view of this, while the sub-throttle valve 5' opens rather slightly in the area where the volumetric efficiency is small, such as the area of low engine speed and the area of high engine speed, as shown in FIG. 18, a change is made so that the sub-throttle valve closes rather slightly in the area where the volumetric efficiency is large, such as the area of medium engine speed. By these variations, air discharge pressure of the mechanical supercharger 6' conforms exactly to the intake air pressure downstream of the mechanical supercharger, with the result that better effects of preventing generation of air intake noises and preventing generation of torque shook are obtained.

In each of the above embodiments, when the mechanical supercharger 6 is switched from the "non-connected state" to the "connected state", the sub-throttle valve 5 throttles further the flow rate of intake air by the fixed amount, in addition to throttling of the flow rate of intake air by the main throttle valve, and after such switchover the sub-throttle valve 5 opens in accordance with the increase of the required output of the engine, but after such switchover the sub-throttle valve 5 may open at a fixed time lag. This is especially suitable for an engine which has a small residual amount of opening after the switchover of the mechanical supercharger 6 from the "non-connected state" to the "connected state".

The present invention is not limited in its application to the engine in each of the above embodiments, but is applicable to any engine of so-called OHC tYpe which utilizes a cam shaft common to air discharge and air intake. In addition, the, mechanical supercharger of the present invention need not necessarily be a screw type mechanical supercharger as in each of the above embodiments or a mechanical supercharger which involves interior compression.

What is claimed is.

1. A supercharging device of an engine, said device comprising:

an air intake passage for supplying intake air to the engine, a mechanical supercharger which is provided in said air intake passage and is driven by an output shaft of the engine, a switching means which switches said mechanical supercharger from a connected state to a non-connected state in response to the output shaft of the engine, a bypass provided in said air intake passage in such a fashion that it bypasses said mechanical supercharger, a main throttle valve provided in said air intake passage upstream of a joint with said bypass on an intake side of said supercharger, and a sub-throttle valve provided in said air intake passage between said joint with said bypass on said intake side of said supercharger and said mechanical supercharger, said sub-throttle valve further throttling a flow rate of intake air by a fixed amount in addition to throttling of the flow rate of intake air by said main throttle valve when said mechanical supercharger is switched from the non-connected state to the connected state and after such switchover opening in response to one of an increase of required output of the engine or a time lag.

2. A supercharging device of an engine as defined in claim 1, wherein said switching means is so designed that it is put in said non-connected state at a time of low load and put in said connected state at a time of high load.

3. A supercharging device of an engine as defined in claim 2, wherein an adjusting valve which opens when at least said switching means is in said non-connected state is provided in said bypass, and said bypass has a passage area which is large enough to secure a flow rate of intake air sufficient for producing a required output of the engine when said switching means is in said non-connected state.

4. A supercharging device of an engine as defined in claim 3, wherein said adjusting valve is so designed that it closes from an opened state at almost the same time as said switching means is switched from said non-connected state to said connected state.

5. A supercharging device of an engine as defined in claim 3, wherein said adjusting valve is a one-way valve which opens only when a pressure f intake air on a discharge side of said supercharger is lower than a pressure of intake air on an intake side of said supercharger.

6. A supercharging device of an engine as defined in claim 4, wherein said sub-throttle valve is so designed that it increases its opening, together with said main throttle valve, in response to an increase of required output of the engine after said switching means is switched from said non-connected state to said connected state.

7. A supercharging device of an engine as defined in claim 6, wherein said sub-throttle valve is so designed that its opening increases by such a degree that the output torque of the engine become equal to the driving torque of said mechanical supercharger when said switching means is switched from said non-connected state to said connected state.

8. A supercharging device of an engine as defined in claim 7, wherein said switching means is so designed that it is in said connected state while the engine running speed is more than a fixed number of revolutions, even at the time of low load.

9. A supercharging device of an engine as defined in claim 8, wherein said mechanical supercharger is of a type involving interior compression.

10. A supercharging device of an engine as defined in claim 9, wherein said sub-throttle valve is so controlled that the discharge air pressure of said mechanical supercharger approaches the intake air pressure downstream from said mechanical supercharger.

11. A supercharging device of an engine as defined in claim 10, wherein said sub-throttle valve is so controlled that said discharge air pressure of said mechanical supercharger is made to be almost equal to said intake air pressure downstream from said mechanical supercharger.

12. A supercharging device of an engine as defined in claim 9, wherein the interior compression ratio of said mechanical supercharger is set at a value to be obtained by dividing the suction force of said mechanical supercharger by the suction force of the engine.

13. A supercharging device of an engine as defined in claim 9, wherein said mechanical supercharger is a screw type supercharger.

14. A supercharging device of an engine as defined in claim 9, wherein said main throttle valve and said sub-throttle valve are connected and interlocked by a link mechanism.

15. A supercharging device of an engine as defined in claim 9, wherein said switching means is so designed that it receives a signal corresponding to intake air pressure downstream of said main throttle valve and when an absolute value of such received intake air pressure becomes higher than a fixed value said switching means is switched from said non-connected state to said connected state, and said adjusting valve is operated by an actuator receiving said intake air pressure downstream from said main throttle value as an operating source, and the biassing force of a spring provided at said actuator to bias said adjusting valve in a closing direction is set at a force which corresponds to said fixed value.

16. A supercharging device of an engine as defined in claim 1, wherein said mechanical supercharger is of a type involving interior compression.

17. A supercharging device of an engine as defined in claim 16, wherein said sub-throttle valve is so controlled that the discharge air pressure of said mechanical supercharger approaches the intake air pressure downstream from said mechanical supercharger.

18. A supercharging device of an engine as defined in claim 17, wherein said sub-throttle valve is so controlled that said discharge air pressure of said mechanical supercharger is made to be almost equal to said intake air pressure downstream from said mechanical supercharger.

19. A supercharging device of an engine as defined in claim 16, wherein the interior compression ratio of said mechanical supercharger is set at a value to be obtained by dividing the suction force of said mechanical supercharger by the suction force of the engine.

20. A supercharging device of an engine as defined in claim 1, wherein said sub-throttle valve is so designed that when said switching means is switched from said non-connected state to said connected state opening of said sub-throttle valve increases by such a degree that the output torque of the engine corresponds to the driving torque of said mechanical supercharger.

21. A supercharging device of an engine as defined in claim 1, wherein a passage are of said air intake passage near said main throttle valve and a passage are of said air intake passage near said sub-throttle are almost equal and the opening of said sub-throttle valve when said switching means is switched from said non-connected state to said connected state is smaller than the opening of said main throttle valve at such time.

22. A supercharging device of an engine as defined in claim 1, wherein said sub-throttle valve is so controlled that after said switching means is switched from said non-connected state to said connected state said sub-throttle valve opens gradually with the lapse of time.

23. A supercharging device of an engine as defined in claim 22, wherein said switching means is so designed that it is switched over in response to the opening of an actuator and at a full opening of said actuator it is switched from said non-connected state to said connected state.

* * * * *